US006527239B1

(12) United States Patent
Smith

(10) Patent No.: US 6,527,239 B1
(45) Date of Patent: Mar. 4, 2003

(54) BEVERAGE CONTAINER HOLDER

(76) Inventor: David E. Smith, 7709 Brookline, Richmond Heights, MO (US) 63117

( * ) Notice: Subject to any disclaimer, the term of this patent is extended or adjusted under 35 U.S.C. 154(b) by 0 days.

(21) Appl. No.: 09/496,512

(22) Filed: Feb. 2, 2000

Related U.S. Application Data

(63) Continuation of application No. 09/007,431, filed on Jan. 14, 1998, now abandoned.

(51) Int. Cl.[7] ..... A47K 1/08

(52) U.S. Cl. ..... 248/311.2; 248/312; 248/309.1; 248/313; 248/310; 4/311; 4/310; 215/393; D6/436; D7/619

(58) Field of Search ..... 248/311.2; 3/312, 3/313, 314, 311.3, 312.1, 309.1, 310, 346.11, 346.5, 213.2, 205.1, 231.31, 224.7, 231.81, 219.2, 205.3; 4/311, 434, 353, 310, 323; 215/393; D6/436; D7/619

(56) References Cited

U.S. PATENT DOCUMENTS

| | | | | | |
|---|---|---|---|---|---|
| 2,814,267 | A | * | 11/1957 | Goldstein et al. | 116/113 |
| 3,273,569 | A | * | 9/1966 | Caliouette | 131/241 |
| 4,271,878 | A | * | 6/1981 | Bologa | 141/975 |
| 5,413,302 | A | * | 5/1995 | Ferster | 248/346.1 |
| 5,433,324 | A | * | 7/1995 | Leonard | 206/534 |
| D361,017 | S | * | 8/1995 | Keven | D7/619 |
| D383,271 | S | * | 9/1997 | Eshelman | D32/54 |
| D400,763 | S | * | 11/1998 | Taylor et al. | D7/619 |

* cited by examiner

*Primary Examiner*—Kimberly Wood
(74) *Attorney, Agent, or Firm*—Thompson Coburn LLP

(57) ABSTRACT

A beverage container support for supporting a beverage upon a component of a flush valve for use in public restroom facilities includes a support surface upon which a beverage container could be placed as well as a depending skirt that can be used as a display surface for advertisements.

16 Claims, 5 Drawing Sheets

BEVERAGE CONTAINER HOLDER

This application is a continuation of the U.S. patent application Ser. No. 09/007,431 filed on Jan. 14, 1998 now abandoned.

BACKGROUND OF THE INVENTION (1) Field of the Invention

This invention relates to an apparatus for supporting beverage containers and, more particularly, to an apparatus for supporting various types of beverage containers upon a component of a toilet or urinal flush valve without spillage while also providing a medium for advertising.

(2) Background of the Invention

In numerous types of public establishments such as bars, pubs, clubs, concert halls, and sporting arenas, patrons often consume beverages. Such patrons often would rather bring their beverages with them while using restroom facilities than leave their beverages unattended. Even when in a situation where the patrons could safely leave their beverages behind while using restroom facilities, many would prefer bringing their beverages along to consume, especially in situations at sporting arenas or other establishments where patrons may have to walk a fair distance or wait in line to use the facilities.

However, when using restroom facilities, there is often no convenient place for the patrons to set or place their beverages so as to free their hands. Men's restroom facilities often have numerous urinals that are unsuited for supporting beverages. These urinals are typically made of porcelain and have an electronically or manually operated water supply flush valve extending from their uppermost surface. Clearances between components of the water supply flush valve and the uppermost surface of the urinals often make it impossible to place various beverage containers directly on the top of the porcelain. Furthermore, the surfaces of urinals are typically sloped to shed water and are therefore unsuited for supporting a beverage container. For those urinals on which a beverage container could be placed, patrons often choose not to place their beverages thereon for sanitary reasons and due to common leakage from components of the water supply flush valve thereabove. As a result of the unsuitability of the urinals themselves as support means, patrons also attempt to alternatively utilize the various components of the water supply flush valve thereabove to support their beverage containers. A common component chosen for this purpose is the valve itself which typically has a horizontally positioned hexagonal nut on the upper most portion of the valve's housing. The hexagonal nut is generally smaller than the base of a typical beverage container and, as a result, beverage containers must be balanced thereon or positioned thereon while leaning the container against the wall that supports the urinal. This induces many patrons to abandon placing their beverages upon the valves. Other components such as horizontally positioned valve inlet pipes have similar disadvantages.

The above mentioned lack of a convenient place to place a beverage container when using restroom facilities is not a problem exclusive to male patrons. Women's restroom facilities typically have toilets with water supply flush valves identical to those provided in men's restroom facilities. As a result of the problems described above, women often attempt to place beverage containers on toilet paper dispensers or other fixtures such as handicap railings. However, not all toilet paper dispensers are suitable for supporting beverage containers and not all stalls are equipped with railings.

A minority of establishments provide shelving or other fixtures that address the needs of their patrons; however, these fixtures are often costly to install or present other health or hazard risks. Thus, there remains an absence of a suitable means for supporting a beverage while using the restroom facilities in many public establishments.

Additionally, it is well known that establishments such as those mentioned above are often sites of intense advertising and promotion for the suppliers of various products such as alcoholic beverages and sport franchises. A tavern, for example, typically displays numerous advertisements promoting various brands of beer and other alcoholic beverages in the form of trademarks displayed on such things as drinking glasses, coasters, neon signs, banners, and streamers. Advertisements like those above are often unsuited for use in public restroom facilities due to the constant cleaning required to maintain cleanliness. Few means of advertising have proven effective in such places and, as a result, many public restroom facilities are devoid of advertisement altogether.

SUMMARY OF THE INVENTION

The invention disclosed herein overcomes the lack of a suitable place for setting a beverage container while using the restroom facilities in many public establishments by providing a device suitable for supporting a beverage container that is configured to be supported by a component of a flush valve. In addition to its utility as a beverage container support, the invention can be provided with a plurality of surfaces for displaying promotional materials in a manner that overcomes the problems associated with prior art advertisement instruments. Since it is customary for men to look straight in front of them when using urinals in public restroom facilities, the invention provides the optimum location for promoters and marketers to display their advertisements. In this respect, such men will, with almost certainty, view the advertisements on the invention if not giving the advertisements their undivided attention for a time period.

DETAIL DESCRIPTION OF THE INVENTION

Figure 1:
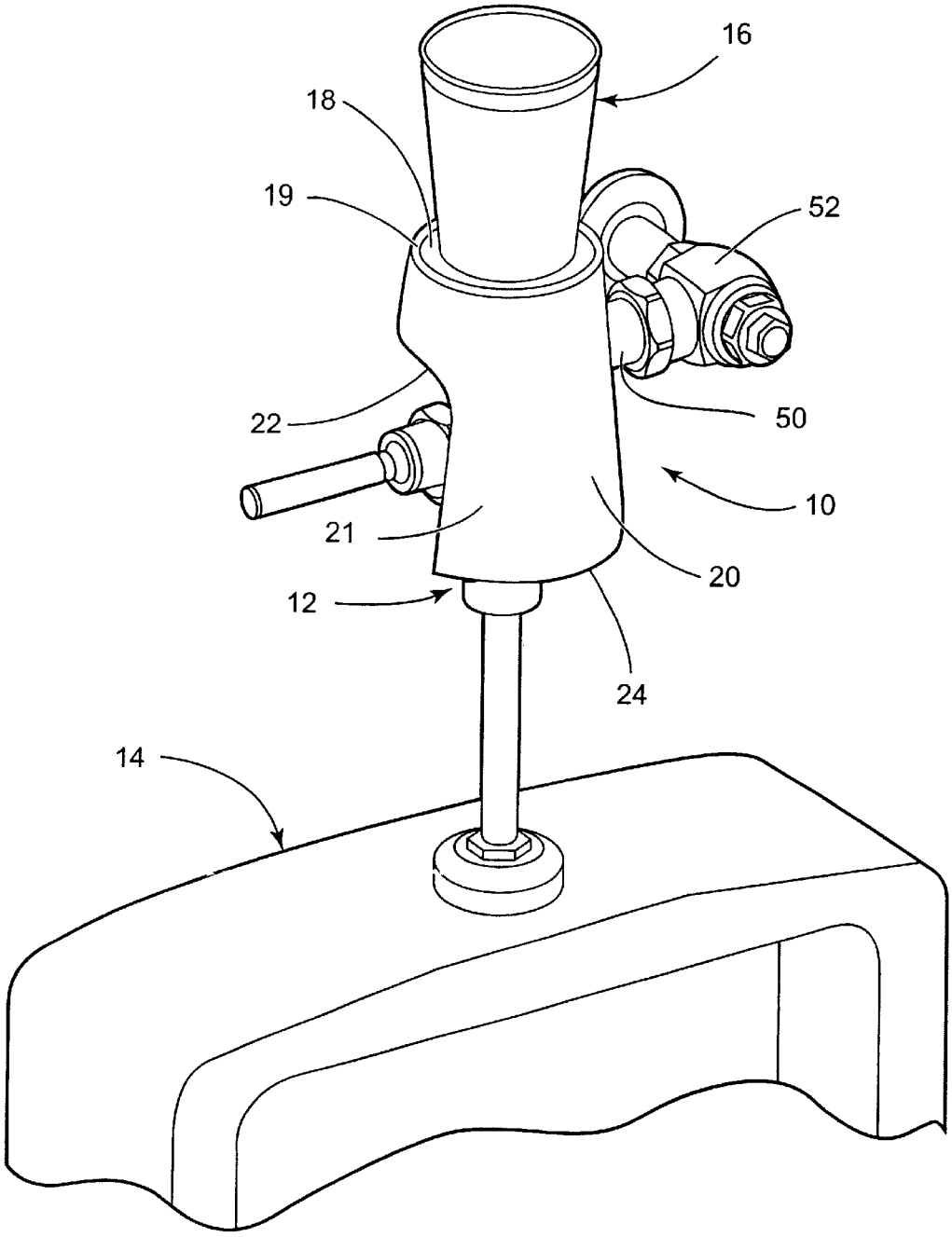
FIG. 1 is an isometric view of the preferred embodiment of the invention shown mounted on a standard flush valve.
Figure 2:
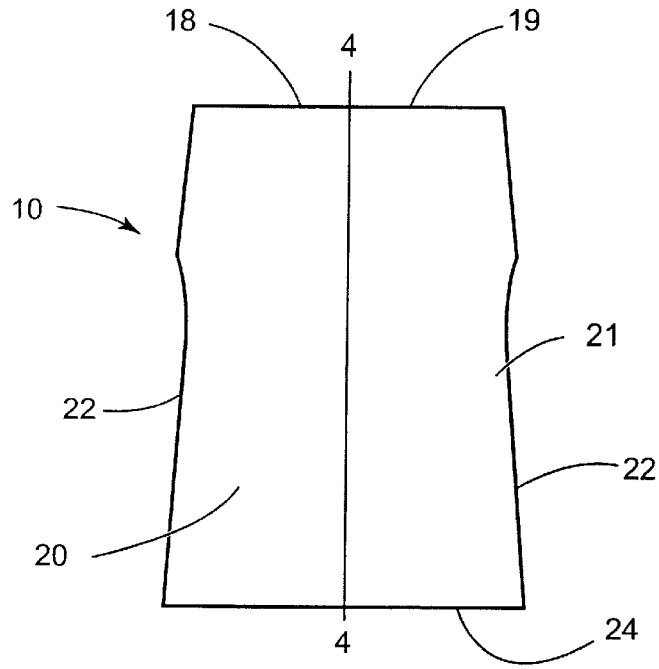
FIG. 2 is front view of the preferred embodiment.
Figure 3:
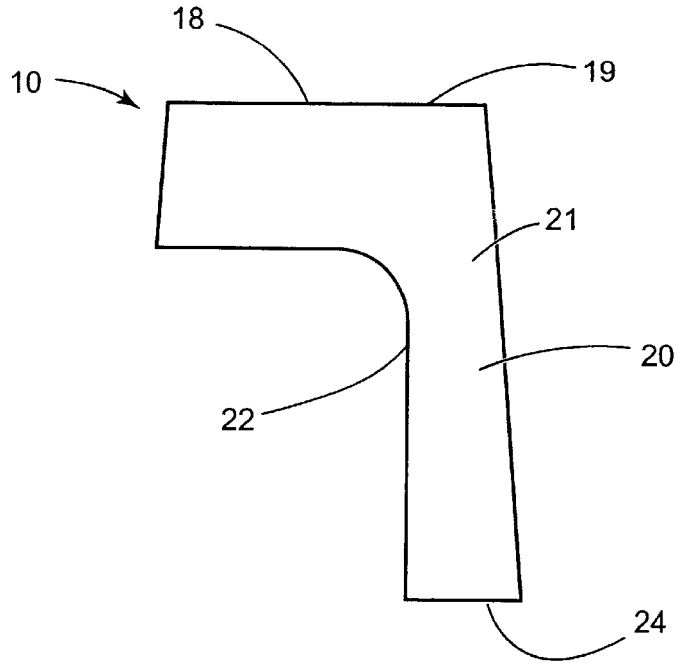
FIG. 3 is a side view of the preferred embodiment.

The preferred embodiment of a beverage container support in accordance with the invention is shown in FIGS. 1–5. The beverage container support 10 is shown in FIG. 1 attached to a flush valve 12 of a urinal 14 and supporting a beverage container 16 placed thereon. The urinal and flush valve shown represent only a typical restroom fixture found in public restroom facilities and the invention is not limited to use with any specific type of flush valve, urinal, or toilet.

As shown in FIGS. 1–5, the preferred embodiment can be molded from a polymeric resin as a single part, thereby minimizing the costs associated with its production. The beverage container support 10 has a discoidal support surface 18 that is capable of supporting a beverage container and the contents of the container placed thereon. The preferred embodiment utilizes a discoidal support surface 18 to allow various shapes and sizes of beverage containers to be placed thereon and to facilitate cleaning of the device. Additionally, an annular rim 19 protrudes upwardly just slightly from the perimeter of the support surface 18 to facilitate proper placement of a beverage container on the support surface 18 when in use. The support surface 18 may be used to display advertisements, thus the height of the rim 19 is limited so as not to obstruct the view of the support surface 18 from the side.

A skirt 20 protrudes downwardly from the perimeter of the support surface 18 and is frustoconical in shape. Near the support surface 18, the skirt 20 is annular and extends completely around the support surface 18 to stiffen the support surface 18. This allows the support surface 18 of the preferred embodiment to be much thinner than would otherwise be sufficient, thereby minimizing the material and corresponding costs of production. In addition to provided additional stiffness to the support surface 18, the skirt 20 provides an additional outwardly facing exterior surface 21 upon which advertisements can be displayed. The frustoconical shape of the skirt 20 of the preferred embodiment increases the area for displaying the advertisements and facilitates viewing of any such advertisements from a point in front of and above the beverage container support 10. Side edges 22 of the skirt 20 extend upwardly from opposite ends of a bottom edge 24 of the skirt 20. The side edges 22 are positioned apart from each other by a distance that maximizes the display area of the skirt but not to the extent that the beverage container support would interfere with various components of typical flush valves when the beverage container support is placed thereon as seen in FIG. 1. This configuration of the skirt allows the skirt 20 to extend further downward over the flush valve than would otherwise be permitted by the flush valve's construction.

Figure 4:
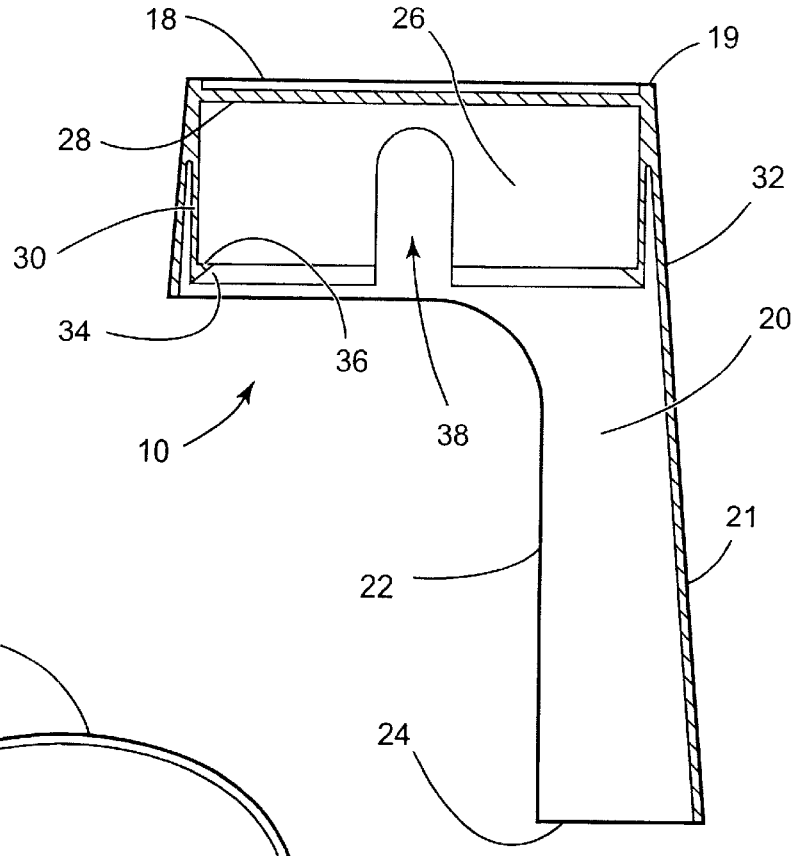
FIG. 4 a cross-sectional view of the preferred embodiment taken along the line 4—4 of FIG. 2.
Figure 5:
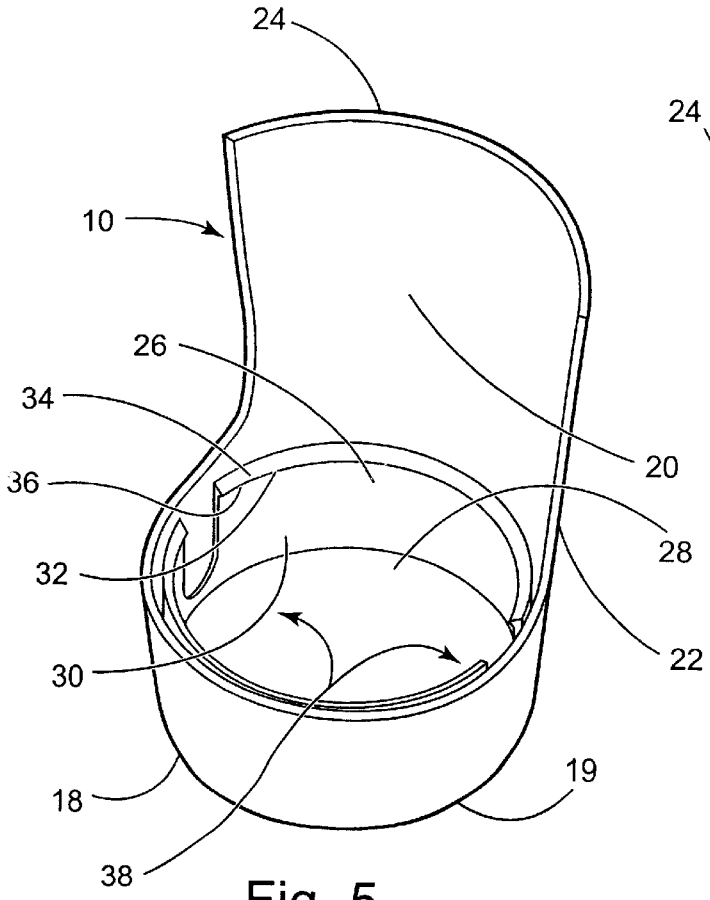
FIG. 5 is an isometric view of the underside of the preferred embodiment showing the preferred locking mechanism.

An attachment portion 26 is connected to the underside of the support surface 18 as shown in FIGS. 4 and 5. The attachment portion 26 is configured to engage a flush valve and to hold the support surface 18 in a generally horizontal position when the beverage container support 10 is mounted on a flush valve. The attachment portion of the preferred embodiment comprises a bottom surface 28 that is opposite the support surface 18 and a cylindrical wall 30 that extends downwardly from where the skirt 20 meets the support surface 18. A plurality of barbs 32, each having a sloped surface 34 and a locking surface 36, are located on the distal edge of the cylindrical wall 30. In the preferred embodiment there are two, arcuate barbs 32 that protrude radially inward. A greater number of barbs could be used. A plurality of cuts 38 segment the cylindrical wall 30 and separate the barbs 32. The cuts 38 allow the cylindrical wall 30 to resiliently deflect radially outwardly and inwardly more easily than if such cuts 38 were not provided.

Figure 6:
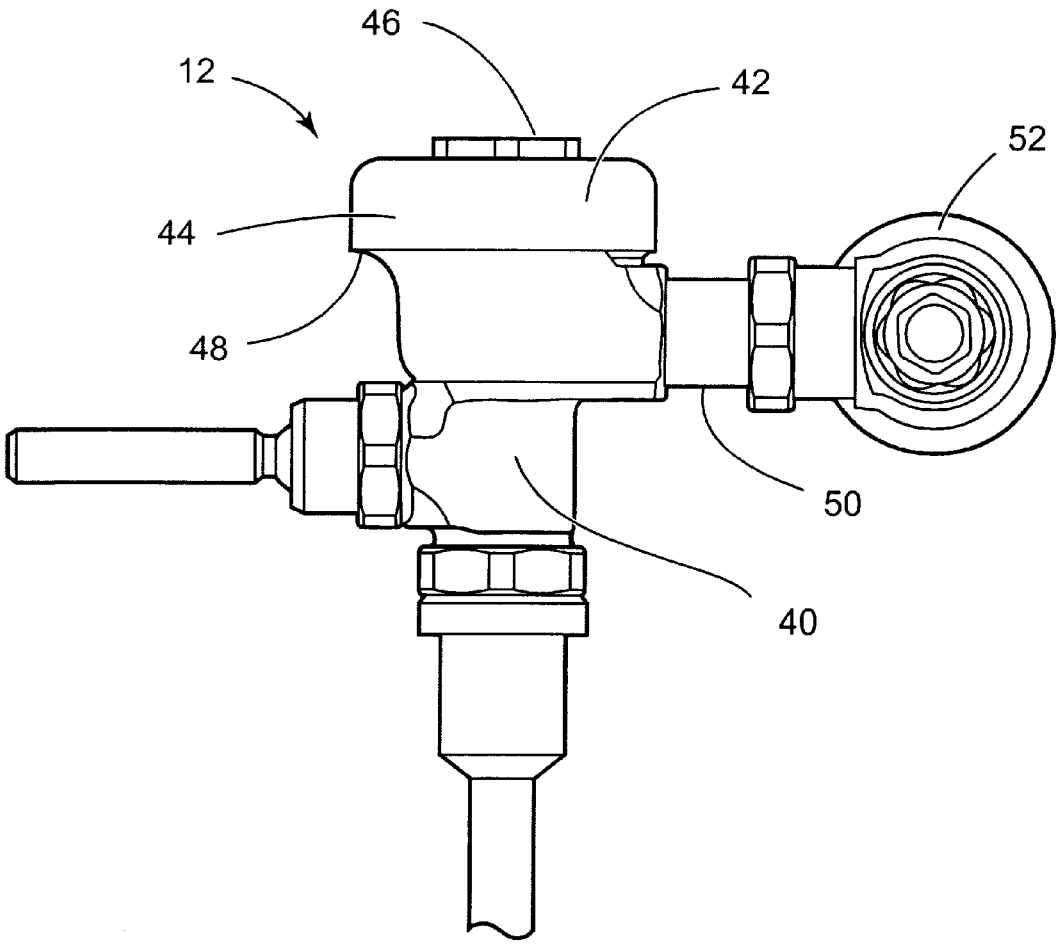
FIG. 6 is a front view of a standard type of flush valve.

The features of the beverage container support 10 described above allow the preferred embodiment to be easily attachable to a typical flush valve. Such a typical flush valve is shown in FIGS. 1 and 6. The preferred embodiment is attached to the flush valve 12 by simply moving the beverage container support 10 vertically downward onto the valve housing 40. The cylindrical wall 30 of the attachment portion 26 is configured such that the inner diameter of the cylindrical wall 30 is dimensioned slightly larger than the diameter of the cap 42 of the valve housing 40, but such that the diameter defined by the barbs 32 is less. When the preferred embodiment is being placed on the flush valve 12, the sloped surfaces 34 of the barbs 32 engage the cylindrical surface 44 of the cap 42 an exert a force radially outward on the cylindrical wall 30 of the attachment portion 26. This force resiliently deflects the cylindrical wall 30 radially outward, which allows the barbs 32 to pass downwardly along the cylindrical surface 44 of the cap 42. The beverage container support 10 can then be moved downward until the bottom surface 28 of the attachment portion 26 engages the valve housing 40.

In the preferred embodiment, the bottom surface 28 of the attachment portion 26 is configured to engage a nut 46 above the cap 42. The cylindrical wall 30 of the attachment portion 26 has a downwardly extending length that is dimensioned such that, in a position with the bottom surface 28 of the attachment portion 26 engaging the nut 46 of the valve housing 40, the barbs 32 are below the lower edge 48 of the cap 42. In this position, the resiliency of the cylindrical wall 30 of the attachment portion 26 forces the cylindrical wall 30 along with the barbs 32 to move radially inward so that the locking surfaces 36 snap beneath the lower edge 48 of the valve housing cap 42. The locking surfaces 36 of the barbs 32 then limit the beverage container support from moving vertically upward relative to the flush valve 12 by engaging the lower edge 48 of the cap 42. Additionally, in this position, the cylindrical wall 30 of the attachment portion 26 engages around the cylindrical surface 44 of the cap 42 and radially supports the beverage container support 10 relative to the flush valve 12 and any vertical load acting on the support surface 18 from a beverage container placed thereon is transferred directly to the nut 46 of the valve housing 40.

Once the beverage container support 10 is attached to a flush valve, the barbs 32 on the attachment portion 26 prevent the beverage container from being easily removed from the valve. However, if the valve requires maintenance or it otherwise becomes necessary to replace or remove the beverage container support 10 from the valve, the beverage container support 10 can be removed from the valve using a prying tool.

In addition to the functional aspects of the attachment portion 26, other features of the preferred embodiment also serve functional purposes. For example, when attached to a flush valve, the skirt conceals the attachment portion, giving the beverage container support a finished look. Additionally, the particular configuration of the preferred embodiment minimizes exposed nooks and crannies such that the support surface 18 and the skirt 20 can be easily wiped clean and innately shed water or liquids. Furthermore, the skirt 20 of the preferred embodiment partially covers the flush valve 12 when attached thereto and can be used to mask unattractive valves as well as displaying an advertisement or other information.

Figure 7:
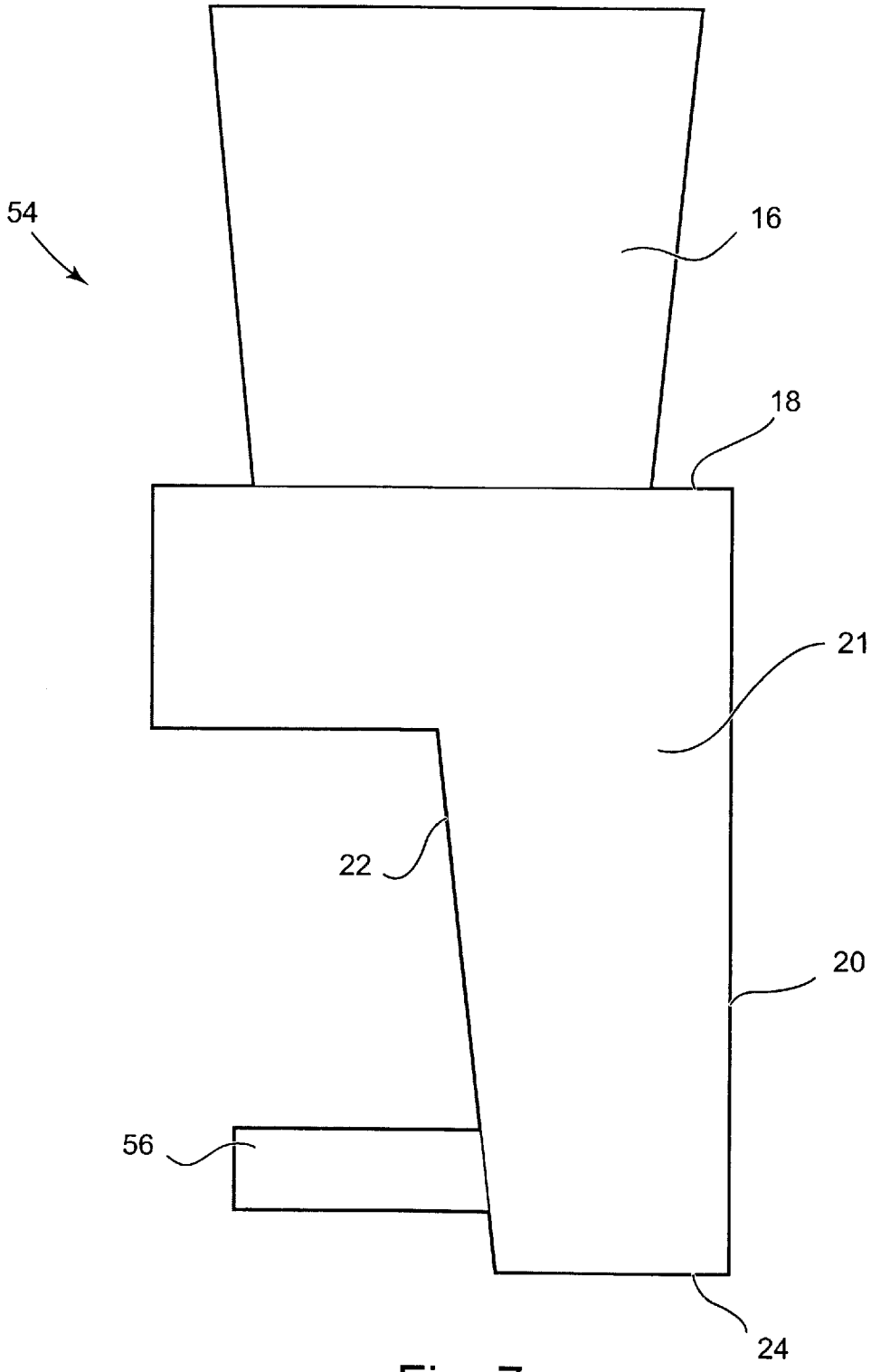
FIG. 7 is a side view of an alternative embodiment of the invention.

While the invention has been described above in reference to the preferred embodiment, it should be understood that other alternative embodiments could be made without departing from the scope of the invention. For example, while the preferred embodiment is configured to be attached to a valve housing of a flush valve, the beverage container support could be configure to attach to any other component of a flush valve such as a water supply pipe 50 or an elbow fitting 52. Additionally, other methods of attachment such an adhesive pad positioned on the bottom surface 28 of a beverage container support where it will attach to the nut 46 of a flush valve 12 could easily be used in place of the barbs 32 of the preferred embodiment. FIG. 7 shows another alternative embodiment of a beverage container support 54 having a band clamp 56 extending horizontally from the skirt 20 that could easily be configured to attach around a component of a flush valve. Furthermore, while the preferred embodiment is designed to be fabricated as a single piece of polymeric material, the invention could also be made from numerous other suitable materials such as a steel or aluminum and could be formed of multiple parts.

It is also known that many variations of flush valves exists. The preferred embodiment is configured to easily mount to the most common types of these valves however, other embodiments could easily be configured to attach to such other types of valves.

What is claimed:

1. A beverage container support for supporting a beverage container on a flush valve component when the beverage container support is attached to the flush valve component and the beverage container is positioned on the beverage container support, the beverage container support comprising:

a support portion having a support surface that is dimensioned to support a container containing a beverage on the support surface;

an attachment portion connected to an underside of the support portion, the attachment portion having means for attaching the support portion to the flush valve component to orient the support surface horizontally on the flush valve component; and, the means for attaching the support portion to the flush valve component includes a cylindrical wall that extends downwardly from the support portion, the cylindrical wall having means for causing the cylindrical wall to deflect radially outwardly in response to pressing the attachment portion downwardly onto the flush valve component.

2. A beverage container support for supporting a beverage container on a flush valve component when the beverage container support is attached to the flush valve component and the beverage container is positioned on the beverage container support, the beverage container support comprising:

a support portion having a support surface that is dimensioned to support a container containing a beverage on the support surface;

an attachment portion connected to an underside of the support portion, the attachment portion having means for attaching the support portion to the flush valve component to orient the support surface horizontally on the flush valve component; and, the means for attaching the support portion to the flush valve component includes a cylindrical wall that extends downwardly from the support portion and at least one barb that protudes radially inwardly from the cylindrical wall.

3. A beverage container support for supporting a beverage container on a flush valve component when the beverage container support is attached to the flush valve component and the beverage container is positioned on the beverage container support, the beverage container support comprising:

a support portion having a support surface that is dimensioned to support a container containing a beverage on the support surface;

an attachment portion connected to an underside of the support portion, the attachment portion having means for attaching the support portion to the flush valve component to orient the support surface horizontally on the flush valve component; and the means for attaching the support portion to the flush valve component includes a band clamp that is configured to attach around the flush valve component.

4. A beverage container support for supporting a beverage container on a flush valve component when the beverage container support is attached to the flush valve component and the beverage container is positioned on the beverage container support, the beverage container support comprising:

a support portion having a support surface that is dimensioned to support a container containing a beverage on the support surface;

an attachment portion connected to an underside of the support portion, the attachment portion having means for attaching the support portion to the flush valve component to orient the support surface horizontally on the flush valve component; and an annular skirt extending downwardly from the support portion and extending around the means for attaching the support portion to the flush valve component.

5. A beverage containing support for supporting a beverage container on a flush valve component when the beverage container support is attached to the flush valve component and the beverage container is positioned on the beverage container support, the beverage container support comprising:

a support portion having a support surface that is dimensioned to support a container containing a beverage on the support surface;

an attachment portion connected to an underside of the support portion, the attachment portion having means for attaching the support portion to the flush valve component to orient the support surface horizontally on the flush valve component;

the support surface having a perimeter edge; and, a skirt protruding downwardly from the support surface perimeter edge.

6. A beverage container support for supporting a beverage container on a flush valve component when the beverage container support is attached to the flush valve component and the beverage container is positioned on the beverage container support, the beverage container support comprising:

a support portion having a support surface, the support surface being dimensioned to support the container containing the beverage on the support surface;

an attachment portion connected to an underside of the support portion, the attachment portion being configured to attach the support portion to the flush valve component to orient the support surface horizontally on the flush valve component; and a skirt protruding downwardly from the support portion and over the attachment portion.

7. The beverage container support of claim 6, further comprising:

the support surface having a perimeter edge and the skirt protruding downwardly from the support surface perimeter edge.

8. The beverage container support of claim 6, further comprising:

the skirt being annular and extending around the attachment portion.

9. The beverage container support of claim 6, further comprising:

the skirt having means for displaying a message.

10. The beverage container support of claim 6, further comprising:

the skirt having a bottom edge and a pair of side edges that are positioned apart from each other and extend upwardly from opposite ends of the bottom edge.

11. The beverage container support of claim 6, further comprising:

the attachment portion having a resilient cylindrical wall that extends downwardly from the support portion and deflects radially outwardly in response to the attachment portion being pressed downwardly onto the flush valve component.

12. The beverage container support of claim 6, further comprising:

the attachment portion having a cylindrical wall that extends downwardly from the support portion, the cylindrical wall having a resiliency that causes the cylindrical wall to deflect radially outwardly in response to the cylindrical wall being pressed downwardly onto the flush valve component.

13. The beverage container support of claim 6, further comprising:

the attachment portion having a cylindrical wall that extends downwardly from the support portion, the cylindrical wall having a plurality of cuts in the cylindrical wall that segment the cylindrical wall and allow the cylindrical wall to resiliently deflect radially inwardly and outwardly.

14. The beverage container support of claim 6, further comprising:

attachment portion having a cylindrical wall that extends downwardly from the support portion, the cylindrical wall having at least one barb that protrudes radially inwardly from the cylindrical wall.

15. The beverage container support of claim 6, further comprising:

the support portion having a bottom surface on an opposite side of the support portion from the support surface; and, an adhesive is positioned on the bottom surface.

16. The beverage container support of claim 6, further comprising:

the attachment portion having a band clamp that is configured to attach around the flush valve component.

* * * * *